US005984468A

United States Patent [19]

Malhotra

[11] Patent Number: 5,984,468

[45] Date of Patent: Nov. 16, 1999

[54] RECORDING SHEETS FOR INK JET PRINTING PROCESSES

[75] Inventor: Shadi L. Malhotra, Mississauga, Canada

[73] Assignee: Xerox Corporation, Stamford, Conn.

[21] Appl. No.: 08/208,317

[22] Filed: Mar. 10, 1994

[51] Int. Cl.[6] ..... B41J 2/01

[52] U.S. Cl. ..... 347/102; 347/105

[58] Field of Search ..... 347/105, 102

[56] References Cited

U.S. PATENT DOCUMENTS

| | | | |
|---|---|---|---|
| 3,561,337 | 2/1971 | Mulkey | 95/1 |
| 4,166,152 | 8/1979 | Baker et al. | 428/522 |
| 4,460,637 | 7/1984 | Miyamoto et al. | 347/102 |
| 4,575,729 | 3/1986 | Ayers et al. | 347/102 |
| 4,592,954 | 6/1986 | Malkotra | 428/335 |
| 4,865,914 | 9/1989 | Malhotra | 428/331 |
| 4,877,678 | 10/1989 | Hasegawa et al. | 428/216 |
| 5,073,448 | 12/1991 | Vieira et al. | 347/105 |
| 5,137,939 | 8/1992 | Siddigui | 523/219 |
| 5,208,093 | 5/1993 | Carls et al. | 428/195 |
| 5,209,962 | 5/1993 | Sakai | 428/195 |
| 5,212,008 | 5/1993 | Malkotra et al. | 428/216 |
| 5,220,346 | 6/1993 | Carreira et al. | 347/102 |
| 5,254,403 | 10/1993 | Malkotra | 428/323 |

FOREIGN PATENT DOCUMENTS

| | | | |
|---|---|---|---|
| 286427 | 8/1988 | European Pat. Off. | B41M 1/30 |
| 3523269 | 2/1986 | Germany | B41M 5/00 |

*Primary Examiner*—Valerie Lund
*Attorney, Agent, or Firm*—Judith L. Byorick

[57] ABSTRACT

Disclosed is a printing process which comprises (a) incorporating into an ink jet printing apparatus containing an aqueous ink a recording sheet which comprises (1) a substrate; (2) a first coating layer which comprises a binder and microspheres; (3) a second, ink-receiving coating layer situated so that the first coating layer is between the second, ink-receiving coating layer and the substrate, said second, ink-receiving layer comprising a hydrophilic binder and microspheres; (4) an optional antistatic agent; (5) an optional biocide; and (6) an optional filler; and (b) causing droplets of the ink to be ejected in an imagewise pattern onto a surface of the recording sheet containing microspheres, thereby generating images on the recording sheet. Also disclosed is a printing process which comprises (a) incorporating into an ink jet printing apparatus containing an aqueous ink a recording sheet which comprises (1) a substrate; (2) a first coating layer which comprises a binder and microspheres; (3) a second, ink-receiving coating layer situated so that the first coating layer is between the second, ink-receiving coating layer and the substrate, said second, ink-receiving layer comprising a hydrophilic binder and microspheres; (4) an optional antistatic agent; (5) an optional biocide; and (6) an optional filler; (b) causing droplets of the ink to be ejected in an imagewise pattern onto a surface of the recording sheet containing microspheres, thereby generating images on the recording sheet; and (c) thereafter exposing the substrate to microwave radiation, thereby drying the recording liquid on the recording sheet.

10 Claims, No Drawings

RECORDING SHEETS FOR INK JET PRINTING PROCESSES

BACKGROUND OF THE INVENTION

The present invention is directed to ink jet printing processes. More specifically, the present invention is directed to ink jet printing processes using recording sheets containing microspheres on at least one surface thereof. One embodiment of the present invention is directed to a printing process which comprises (a) incorporating into an ink jet printing apparatus containing an aqueous ink a recording sheet which comprises (1) a substrate; (2) a first coating layer which comprises a binder and microspheres; (3) a second, ink-receiving coating layer situated so that the first coating layer is between the second, ink-receiving coating layer and the substrate, said second, ink-receiving layer comprising a hydrophilic binder and microspheres; (4) an optional antistatic agent; (5) an optional biocide; and (6) an optional filler; and (b) causing droplets of the ink to be ejected in an imagewise pattern onto a surface of the recording sheet containing microspheres, thereby generating images on the recording sheet. Another embodiment of the present invention is directed to a printing process which comprises (a) incorporating into an ink jet printing apparatus containing an aqueous ink a recording sheet which comprises (1) a substrate; (2) a first coating layer which comprises a binder and microspheres; (3) a second, ink-receiving coating layer situated so that the first coating layer is between the second, ink-receiving coating layer and the substrate, said second, ink-receiving layer comprising a hydrophilic binder and microspheres; (4) an optional antistatic agent; (5) an optional biocide; and (6) an optional filler; (b) causing droplets of the ink to be ejected in an imagewise pattern onto a surface of the recording sheet containing microspheres, thereby generating images on the recording sheet; and (c) thereafter exposing the substrate to microwave radiation, thereby drying the recording liquid on the recording sheet.

U.S. Pat. No. 5,137,939 (Siddiqui), the disclosure of which is totally incorporated herein by reference, discloses films or sheets of linear polyester containing glass spheres having a certain particle size distribution and in a certain amount based upon the weight of the polyester film. The addition of the glass spheres improves several properties of the film, including the dynamic coefficient of friction. Preferably, a second film additive, fumed silica, of a controlled particle size distribution and weight, is additionally added to the film. The addition of the fumed silica additionally improves several properties of the polyester film, including the static coefficient of friction of the film.

U.S. Pat. No. 4,166,152 (Baker et al.), the disclosure of which is totally incorporated herein by reference, discloses infusible, solvent-insoluble, solvent-dispersible, inherently tacky, elastomeric polymeric microspheres which are formed from non-ionic monomers and comprise at least one oleophilic water-emulsifiable alkyl acrylate or methacrylate ester. The microspheres are prepared by a suspension polymerization technique which includes the use of an ionic suspension stabilizer.

U.S. Pat. No. 3,561,337 (Mulkey) discloses a sheet material having a transparent backing coated with a layer containing a polymeric binder and particles of solid material which is insoluble in the binder. The refractive index of the solid material varies from that of the binder by at most ±0.6. The surface of the layer is ink receptive and, by printing on that surface, a transparency is obtained.

U.S. Pat. No. 5,212,008 (Malhotra et al.), the disclosure of which is totally incorporated herein by reference, discloses a recording sheet which comprises a substrate; a first coating in contact with the substrate which comprises a crosslinking agent selected from the group consisting of hexamethoxymethyl melamine, methylated melamine-formaldehyde, methylated urea-formaldehyde, cationic urea-formaldehyde, cationic polyamine-epichlorohydrin, glyoxal-urea resin, poly (aziridine), poly (acrylamide), poly (N,N-dimethyl acrylamide), acrylamide-acrylic acid copolymer, poly (2-acrylamido-2-methyl propane sulfonic acid), poly (N,N-dimethyl-3,5-dimethylene piperidinium chloride), poly (methyleneguanidine) hydrochloride, poly (ethylene imine) poly (ethylene imine) epichlorohydrin, poly (ethylene imine) ethoxylated, glutaraldehyde, and mixtures thereof; a catalyst; and a polymeric material capable of being crosslinked by the crosslinking agent and selected from the group consisting of polysaccharides having at least one hydroxy group, polysaccharides having at least one carboxy group, polysaccharides having at least one sulfate group, polysaccharides having at least one amine or amino group, polysaccharide gums, poly (alkylene oxides), vinyl polymers, and mixtures thereof; and a second coating in contact with the first coating which comprises a binder and a material selected from the group consisting of fatty imidazolines, ethosulfate quaternary compounds, dialkyl dimethyl methosulfate quaternary compounds, alkoxylated di-fatty quaternary compounds, amine oxides, amine ethoxylates, Imidazoline quaternary compounds, alkyl benzyl dimethyl quaternary compounds, poly (epiamines), and mixtures thereof.

U.S. Pat. No. 4,865,914 (Malhotra), the disclosure of which is totally incorporated herein by reference, discloses a transparency comprising a supporting substrate and thereover a blend comprising poly(ethylene oxide) and carboxy methyl cellulose together with a component selected from the group consisting of (1) hydroxypropyl cellulose; (2) vinylmethyl ether/maleic acid copolymer; (3) carboxymethyl hydroxyethyl cellulose; (4) hydroxyethyl cellulose; (5) acrylamide/acrylic acid copolymer; (6) cellulose sulfate; (7) poly(2-acrylamido-2-methyl propane sulfonic acid); (8) poly(vinyl alcohol); (9) poly(vinyl pyrrolidone); and (10) hydroxypropyl methyl cellulose. In addition, papers with the aforementioned coatings are disclosed.

U.S. Pat. No. 4,592,954 (Malhotra), the disclosure of which is totally incorporated herein by reference, discloses a transparency for ink jet printing comprising a supporting substrate and thereover a coating consisting essentially of a blend of carboxymethyl cellulose and polyethylene oxides. Also disclosed are papers for use in ink jet printing comprising a plain paper substrate and a coating thereover consisting essentially of polyethylene oxides.

U.S. Pat. No. 5,254,403 (Malhotra), the disclosure of which is totally incorporated herein by reference, discloses a recording sheet which comprises a substrate and an image receiving layer comprising a mixture of (a) a polymer capable of forming a latex and selected from the group consisting of poly (vinyl chloride), ethylene-vinyl chloride copolymers, poly (vinyl acetate), carboxylated poly (vinyl acetate), ethylene-vinyl acetate copolymers, polymers containing acrylate monomers, poly styrene, styrene-butadiene copolymers, carboxylated styrene-butadiene copolymers, butadiene-acrylonitrile copolymers, butadiene-acrylonitrile-styrene copolymers, and mixtures thereof; (b) a polysaccharide; and (c) a polymer containing oxyalkylene monomers.

U.S. Pat. No. 5,208,093 (Carls et al.), the disclosure of which is totally incorporated herein by reference, discloses an electrographic article comprising a polymeric film having at least one polymeric receptor layer coated on at least one side thereof, said receptor layer having an equivalent or lower storage elasticity modulus than a toner resin used for forming images on the article.

Copending application U.S. Ser. No. 08/036,575, entitled "Transparent Recording Sheets," with the named inventor Shadi L. Malhotra, filed Mar. 19, 1993, the disclosure of which is totally incorporated herein by reference, discloses a substantially transparent recording sheet which comprises (a) a substantially transparent substrate; (b) a binder polymer coated on the substrate; and (c) particles of an antistatic component, said particles being present on at least the surface of the binder polymer coating.

While known materials and processes are suitable for their intended purposes, a need remains for improved recording sheets. In addition, there is a need for improved recording sheets suitable for use in ink jet printing processes. Further, a need remains for recording sheets which exhibit rapid drying times when imaged with aqueous inks. Additionally, a need remains for recording sheets coated with a discontinuous, porous film. A need also remains for recording sheets which are particularly suitable for use in printing processes wherein the recorded substrates are imaged with liquid inks and dried by exposure to microwave radiation. There is also a need for recording sheets which, subsequent to being imaged with an aqueous ink and dried by exposure to microwave radiation, exhibit little or no curling.

SUMMARY OF THE INVENTION

It is an object of the present invention to provide a printing process with the above advantages.

It is another object of the present invention to recording sheets processes suitable for use in ink jet printing processes.

It is yet another object of the present invention to provide recording sheets which exhibit rapid drying times when imaged with aqueous inks.

It is still another object of the present invention to provide recording sheets which are particularly suitable for use in printing processes wherein the recorded substrates are imaged with liquid inks and dried by exposure to microwave radiation.

Another object of the present invention is to provide recording sheets coated with a discontinuous, porous film.

Yet another object of the present invention is to provide recording sheets which, subsequent to being imaged with an aqueous ink and dried by exposure to microwave radiation, exhibit little or no curling.

These and other objects of the present invention (or specific embodiments thereof) can be achieved by providing a printing process which comprises (a) incorporating into an ink jet printing apparatus containing an aqueous ink a recording sheet which comprises (1) a substrate; (2) a first coating layer which comprises a binder and microspheres; (3) a second, ink-receiving coating layer situated so that the first coating layer is between the second, ink-receiving coating layer and the substrate, said second, ink-receiving layer comprising a hydrophilic binder and microspheres; (4) an optional antistatic agent; (5) an optional biocide; and (6) an optional filler; and (b) causing droplets of the ink to be ejected in an imagewise pattern onto a surface of the recording sheet containing microspheres, thereby generating images on the recording sheet. Another embodiment of the present invention is directed to a printing process which comprises (a) incorporating into an ink jet printing apparatus containing an aqueous ink a recording sheet which comprises (1) a substrate; (2) a first coating layer which comprises a binder and microspheres; (3) a second, ink-receiving coating layer situated so that the first coating layer is between the second, ink-receiving coating layer and the substrate, said second, ink-receiving layer comprising a hydrophilic binder and microspheres; (4) an optional antistatic agent; (5) an optional biocide; and (6) an optional filler; (b) causing droplets of the ink to be ejected in an imagewise pattern onto a surface of the recording sheet containing microspheres, thereby generating images on the recording sheet; and (c) thereafter exposing the substrate to microwave radiation, thereby drying the recording liquid on the recording sheet.

DETAILED DESCRIPTION OF THE INVENTION

The recording sheets of the present invention comprise a substrate and at least two coating layers containing microspheres. Any suitable substrate can be employed. Examples include transparent materials, such as polyester, including Mylar™, available from E. I. Du Pont de Nemours & Company, Melinex™, available from Imperial Chemicals, Inc., Celanar™, available from Celanese Corporation, polyethylene naphthalates, such as Kaladex PEN films, available from Imperial Chemicals, Inc., polycarbonates such as Lexan™, available from General Electric Company, polysulfones, such as those available from Union Carbide Corporation, polyether sulfones, such as those prepared from 4,4'-diphenyl ether, such as Udel™, available from Union Carbide Corporation, those prepared from disulfonyl chloride, such as Victrex™, available from ICI America Incorporated, those prepared from biphenylene, such as Astrel™, available from 3M Company, poly (arylene sulfones), such as those prepared from crosslinked poly (arylene ether ketone sulfones), cellulose triacetate, polyvinylchloride cellophane, polyvinyl fluoride, polyimides, and the like, with polyester such as Mylar™ being preferred in view of its availability and relatively low cost. The substrate can also be opaque, including opaque plastics, such as Teslin™, available from PPG Industries, and filled polymers, such as Melinex®, available from ICI. Filled plastics can also be employed as the substrate, particularly when it is desired to make a "never-tear paper" recording sheet. Paper is also suitable, including plain papers such as Xerox® 4024, diazo papers, or the like.

In one embodiment of the present invention, the substrate comprises sized blends of hardwood kraft and softwood kraft fibers containing from about 10 to 90 percent by weight soft wood and from about 10 to about 90 percent by weight hardwood. Examples of hardwood include Seagull W dry bleached hardwood kraft, present in one embodiment in an amount of about 70 percent by weight. Examples of softwood include La Tuque dry bleached softwood kraft, present in one embodiment in an amount of about 30 percent by weight. These substrates can also contain fillers and pigments in any effective amounts, typically from about 1 to about 60 percent by weight, such as clay (available from Georgia Kaolin Company, Astro-fil 90 clay, Engelhard Ansilex clay), titanium dioxide (available from Tioxide Company—Anatase grade AHR), calcium silicate CH-427-97-8, XP-974 (J.M. Huber Corporation), and the like. The sized substrates can also contain sizing chemicals in any effective amount, typically from about 0.25 percent to about 25 percent by weight of pulp, such as acidic sizing, including Mon size (available from Monsanto Company), alkaline sizing such as Hercon-76 (available from Hercules Company), Alum (available from Allied Chemicals as Iron free alum), retention aid (available from Allied Colloids as Percol 292), and the like. The preferred internal sizing degree of papers selected for the present invention, including commercially available papers, varies from about 0.4 to about 5,000 seconds, and papers in the sizing range of from about 0.4 to about 300 seconds are more preferred, primarily to decrease costs. Preferably, the selected substrate is porous, and the porosity value of the selected substrate preferably varies from about 100 to about 1,260 milliliters per minute and preferably from about 50 to about 600 milliliters per minute to enhance the effectiveness of the recording sheet in ink jet processes. Preferred basis weights for the substrate are from about 40 to about 400 grams per square meter, although the basis weight can be outside of this range.

Illustrative examples of commercially available internally and externally (surface) sized substrates suitable for the present invention include Diazo papers, offset papers, such as Great Lakes offset, recycled papers, such as Conservatree, office papers, such as Automimeo, Eddy liquid toner paper and copy papers available from companies such as Nekoosa, Champion, Wiggins Teape, Kymmene, Modo, Domtar, Veitsiluoto and Sanyo, and the like, with Xerox® 4024™ papers and sized calcium silicate-clay filled papers being particularly preferred in view of their availability, reliability, and low print through. Pigmented filled plastics, such as Teslin (available from PPG industries), are also preferred as supporting substrates.

The substrate can be of any effective thickness. Typical thicknesses for the substrate are from about 50 to about 500 microns, and preferably from about 100 to about 125 microns, although the thickness can be outside these ranges.

Situated on the substrate are at least two layers containing microspheres. The microspheres can be either hollow or solid, and have a typical average particle diameter of from about 0.1 to about 50 microns, preferably from about 1 to about 10 microns, although the particle size can be outside these ranges. Examples of hollow microspheres include Eccospheres MC-37 (sodium borosilicate glass), Eccospheres FTD 202 (high silica glass, 95% $S10_2$), and Eccospheres SI (high silica glass, 98% $S10_2$), all available from Emerson and Cuming Inc.; Fillite 200/7 (alumino-silicate ceramic, available from Fillite U.S.A.); Q-Cel 300 (sodium borosilicate, available from Philadelphia Quartz); B23/500 (soda lime glass, available from 3M Company); Ucar BJ0-0930 (phenolic polymers, available from Union Carbide); Miralite 177 (vinylidene chloride-acrylonitrile, available from Pierce & Stevens Chemical Corp.); and the like. Examples of solid microspheres include Spheriglass E250P2 and 10002A (soda-lime glass A-glass, E-glass), available from Potters Industries; Micro-P (soda-lime glass), available from D.J. Enterprises; ceramic microspheres (available from Fillite U.S.A. and Zeelan Industries); glass beads 3–10 microns (#07666, available from Polymer Sciences Inc); solid plastic microspheres, available from Rohm & Haas, Dow Chemicals, Diamond Shamrock, and E.I. DuPont de Nemours & Co.; and the like. Mixtures of two or more types of microspheres can also be employed. Further information regarding microspheres is disclosed in, for example, *Encyclopedia of Polymer Science and Engineering*, vol. 9, p. 788 et seq., John Wiley and Sons (New York 1987), the disclosure of which is totally incorporated herein by reference.

The first coating layer, situated between the second ink-receiving coating layer and the substrate, typically contains microspheres in an amount of from about 0.25 to about 50 percent by weight, and preferably from about 2.5 to about 25 percent by weight, although the amount can be outside these ranges.

Any suitable binder can be employed in the first coating layer. Preferably, the binder is either soluble in a solvent or melt extrudable. Examples of solvent-soluble binder materials include polyacrylic acid, such as #598, #599, #600, #413, available from Scientific Polymer Products, poly (hydroxyalkyl methacrylates), wherein alkyl has from 1 to about 18 carbon atoms, including methyl, ethyl, propyl, butyl, hexadecyl, and the like, including poly(2-hydroxyethylmethacrylate), such as #414, #815, available from Scientific Polymer Products, and poly (hydroxypropylmethacrylate), such as #232 available from Scientific Polymer Products, poly (hydroxyalkylacrylates), wherein alkyl is methyl, ethyl, or propyl, including poly(2-hydroxyethyl acrylate), such as #850, available from Scientific Polymer Products, and poly(hydroxypropyl acrylate), such as #851, available from Scientific Polymer Products, vinyl alcohol-vinyl acetate copolymers, including those with a vinyl alcohol content of about 9 percent by weight, such as #379, available from Scientific Polymer Products, vinyl alcohol-vinyl butyral copolymers, including those with a vinyl alcohol content of about 19.5 percent by weight, such as #381, available from Scientific Polymer Products, alkyl cellulose or aryl cellulose, wherein alkyl is methyl, ethyl, propyl, or butyl and aryl is phenyl or the like, including ethyl cellulose such as Ethocel N-22, available from Hercules Chemical Company, poly (vinylacetate), such as #346, #347, available from Scientific Polymer Products, and the like; ketone soluble polymers, such as those polymers soluble in acetone, including hydroxyalkyl cellulose acrylates and hydroxyaryl cellulose acrylates, wherein alkyl is methyl, ethyl, propyl, or butyl and aryl is phenyl or the like, including hydroxyethyl cellulose acrylate, such as #8630, available from Monomer-Polymer and Dajac Laboratories Inc., hydroxyalkyl cellulose methacrylates and hydroxyaryl cellulose methacrylates, wherein alkyl is methyl, ethyl, propyl, or butyl and aryl is phenyl or the like, including hydroxyethyl cellulose methacrylate, such as #8631, available from Monomer-Polymer and Dajac Laboratories Inc., cellulose-acrylamide adducts, such as #8959, #8960, #8961, #8962, available from Monomer-Polymer and Dajac Laboratories, Inc., poly (vinyl butyral), such as #043, #511, #507, available from Scientific Polymer Products, cyanoethylated cellulose, such as #091, available from Scientific Polymer Products, cellulose acetate hydrogen phthalate, such as #085, available from Scientific Polymer Products, hydroxypropylmethyl cellulose phthalate, such as HPMCP, available from Shin-Etsu Chemical, hydroxypropyl methyl cellulose succinate, such as HPMCS, available from Shin-Etsu Chemical, cellulose triacetate, such as #031, available from Scientific Polymer Products, poly ($\alpha$-methylstyrene), such as #309, available from Scientific Polymer Products, styrene-butadiene copolymers, such as Kraton G-1652, Kraton DX-1150, and Kraton elastomer (such as D1107, G-1657, G-1657/FG1901, D-1101, FG1901, available from Shell Corporation), styrene-butylmethacrylate copolymers, such as #595, available from Scientific Polymer Products, vinyl chloride-vinylacetate-vinyl alcohol terpolymers, such as #428, available from Scientific Polymer Products, chlorinated solvent soluble polymers, such as poly (p-phenylene ether-sulfone) (such as #392, available from Scientific Polymer Products), polysulfones, such as #046, available from Scientific Polymer Products, aromatic ester carbonate copolymers, such as APE KLI-9306, APE KLI-9310, available from Dow Chemical Company, poly carbonates, such as #035, available from Scientific Polymer Products, α-methylstyrene-dimethylsiloxane block copolymers, such as PS 0965, available from Petrarch Systems, dimethyl siloxane-bisphenol A carbonate block copolymers, such as PSO99, available from Petrarch Systems, poly (2,6-dimethyl p-phenylene oxide), such as #126, available from Scientific Polymer Products, poly (2,4,6-tribromostyrene), such as #166, available from Scientific Polymer Products, ethylene-maleic anhydride copolymers, such as #2308, available from Polysciences, Inc., also available as EMA from Monsanto Chemical Co., and the like, as well as blends or mixtures of any of the above.

Examples of melt extrudable polymers suitable as binder polymers for the first coating layer include (a) propylene-acrylic acid copolymers, such as those with a propylene content of 94 percent by weight (#585, available from Scientific Polymer Products); (b) propylene-ethylene-acrylic acid terpolymers such as those with a propylene content of 75 percent by weight, ethylene content of 19 percent by weight, and acrylic acid content of 6 percent by weight (#586, available from Scientific Polymer Products); (c) poly (vinyl methyl ketone) (#280 Scientific Polymer Products); (d) poly (trimethyl hexamethylene) terephthalamide [Nylon 6(3)T] (#331, available from Scientific Polymer Products); (e) chlorinated polypropylene isotactic, chlorine content from about 26 percent by weight (#642) to about 65 percent by weight (#117), available from Scientific Polymer Products); (f) poly (hexamethylene sebacate) (#124, available from Scientific Polymer Products); (g) poly(ethylene succinate) (#150, available from Scientific Polymer Products); (h) polyamide resin (#385, #386, #387, #388, #389, #390, available from Scientific Polymer Products); (i) Nylon 6 [poly (caprolactam)] (#034, available from Scientific Polymer Products); (j) Nylon 6/6 [poly (hexamethylene adipamide)] (#033, available from Scientific Polymer Products); (k) Nylon 6/9 [poly (hexamethylene nonaneamide)] (#156, available from Scientific Polymer Products); (l) Nylon 6/10 [poly (hexamethylene sebacamide)] (#139, available from Scientific Polymer Products); (m) Nylon 6/12 [poly (hexamethylene dodecane diamide)] (#313, available from Scientific Polymer Products); (n) Nylon 11 [poly (undecanoamide)] (#006, available from Scientific Polymer Products); (o) Nylon 12 [poly (lauryllactam)] (#44, available from Scientific Polymer Products); (p) ethylene-methacrylic acid ionomers, sodium ion (#465, #466, #467, #468) and ethylene-methacrylic acid ionomers zinc ion (#469, #470, #471, #472), available from Scientific Polymer Products); and the like, as well as blends or mixtures of any of the above.

Any mixtures of the above binder materials in any relative amounts can be employed.

The first coating layer typically has a thickness of from about 1 to about 25 microns, preferably from about 5 to about 10 microns, although the thickness can be outside these ranges.

The second, ink-receiving coating layer typically contains microspheres in an amount of from about 0.1 to about 10 percent by weight, and preferably from about 0.1 to about 3 percent by weight, although the amount can be outside these ranges.

The second, ink-receiving coating layer also contains a hydrophilic binder. For the purposes of the present invention, the term hydrophilic refers to those materials which are compatible with aqueous inks and enable the formation of images with aqueous inks on the second ink-receiving coating layer. Examples of hydrophilic polymers suitable for the second ink-receiving coating layer include polymer latices. The polymer capable of forming a latex is, for the purposes of the present invention, a polymer that forms in water or in an organic solvent a stable colloidal system in which the disperse phase is polymeric. Examples of suitable latex-forming polymers include polyester latex such as Eastman AQ 29D available from Eastman Chemical Company, vinyl chloride latex, such as Geon 352 from B.F. Goodrich Chemical Group, ethylene-vinyl chloride copolymer emulsions, such as Airflex ethylene-vinyl chloride from Air Products and Chemicals, poly vinyl acetate homopolymer emulsions, such as Vinac from Air Products and Chemicals, carboxylated vinyl acetate emulsion resins, such as Synthemul synthetic resin emulsions 40-502, 40-503, and 97-664 from Reichhold Chemicals Inc. and Polyco 2149, 2150, and 2171, from Rohm and Haas Co., vinyl acetate copolymer latex, such as 76 RES 7800 from Union Oil Chemicals Divisions and Resyn 25-1103, Resyn 25-1109, Resyn 25-1119, and Resyn 25-1189 from National Starch and Chemical Corporation, ethylene-vinyl acetate copolymer emulsions, such as Airflex ethylene-vinylacetate from Air Products and Chemicals Inc., acrylic-vinyl acetate copolymer emulsions, such as Rhoplex AR-74 from Rohm and Haas Co, Synthemul 97-726 from Reichhold Chemicals Inc., Resyn 25-1140, 25-1141, 25-1142, and Resyn-6820 from National Starch and Chemical Corporation, vinyl acrylic terpolymer latex, such as 76 RES 3103 from Union Oil Chemical Division and Resyn 25-1110 from National Starch and Chemical Corporation, acrylic emulsion latex, such as Rhoplex B-15J, Rhoplex P-376, Rhoplex TR-407, Rhoplex E-940, Rhoplex TR-934, Rhoplex TR-520, Rhoplex HA-24, and Rhoplex NW-1825 from Rohm and Haas Company and Hycar 2600 X 322, Hycar 2671, Hycar 2679, Hycar 26120, and Hycar 2600 X347 from B.F. Goodrich Chemical Group, polystyrene latex, such as DL6622A, DL6688A, and DL6687A from Dow Chemical Company, styrene-butadiene latexes, such as 76 RES 4100 and 76 RES 8100 available from Union Oil Chemicals Division, Tylac resin emulsion 68-412, Tylac resin emulsion 68-067, 68-319, 68-413, 68-500, 68-501, available from Reichhold Chemical Inc., and DL6672A, DL6663A, DL6638A, DL6626A, DL6620A, DL615A, DL617A, DL620A, DL640A, DL650A From Dow Chemical Company, butadiene-acrylonitrile latex, such as Hycar 1561 and Hycar 1562 from B. F. Goodrich Chemical Group and Tylac Synthetic Rubber Latex 68-302 from Reichhold Chemicals Inc., butadiene-acrylonitrile-styrene terpolymer latex, such as Tylac synthetic rubber latex 68-513 from Reichhold Chemicals Inc., and the like, as well as mixtures thereof.

Also suitable as binder polymers for the second, ink-receiving layer are (a) hydrophilic polysaccharides and their modifications, such as (1) starch (such as starch SLS-280, available from St. Lawrence starch), (2) cationic starch (such as Cato-72, available from National Starch), (3) hydroxyalkylstarch, wherein alkyl has at least one carbon atom and wherein the number of carbon atoms is such that the material is water soluble, preferably from about 1 to about 20 carbon atoms, and more preferably from about 1 to about 10 carbon atoms, such as methyl, ethyl, propyl, butyl, or the like (such as hydroxypropyl starch (#02382, available from Poly Sciences Inc.) and hydroxyethyl starch (#06733, available from Poly Sciences Inc.)), (4) gelatin (such as Calfskin gelatin #00639, available from Poly Sciences Inc.), (5) alkyl celluloses and aryl celluloses, wherein alkyl has at least one carbon atom and wherein the number of carbon atoms is such that the material is water soluble, preferably from 1 to about 20 carbon atoms, more preferably from 1 to about 10 carbon atoms, and even more preferably from 1 to about 7 carbon atoms, such as methyl, ethyl, propyl, butyl, pentyl, hexyl, benzyl, and the like (such as methyl cellulose (Methocel AM 4, available from Dow Chemical Company)), and wherein aryl has at least 6 carbon atoms and wherein the number of carbon atoms is such that the material is water soluble, preferably from 6 to about 20 carbon atoms, more preferably from 6 to about 10 carbon atoms, and even more preferably about 6 carbon atoms, such as phenyl, (6) hydroxy alkyl celluloses, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like (such as hydroxyethyl cellulose (Natrosol 250 LR, available from Hercules Chemical Company), and hydroxypropyl cellulose (Klucel Type E, available from Hercules Chemical Company)), (7) alkyl hydroxy alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like (such as ethyl hydroxyethyl cellulose (Bermocoll, available from Berol Kem. A.B. Sweden)), (8) hydroxy alkyl alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as hydroxyethyl methyl cellulose (HEM, available from British Celanese Ltd., also available as Tylose MH, MHK from Kalle A. G.), hydroxypropyl methyl cellulose (Methocel K35LV, available from Dow Chemical Company), and hydroxy butylmethyl cellulose (such as HBMC, available from Dow Chemical Company)), (9) dihydroxyalkyl cellulose, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as dihydroxypropyl cellulose, which can be prepared by the reaction of 3-chloro-1,2-propane with alkali cellulose), (10) hydroxy alkyl hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as hydroxypropyl hydroxyethyl cellulose, available from Aqualon Company), (11) halodeoxycellulose, wherein halo represents a halogen atom (such as chlorodeoxycellulose, which can be prepared by the reaction of cellulose with sulfuryl chloride in pyridine at 25° C.), (12) amino deoxycellulose (which can be prepared by the reaction of chlorodeoxy cellulose with 19 percent alcoholic solution of ammonia for 6 hours at 160° C.), (13) dialkylammonium halide hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom (such as diethylammonium chloride hydroxy ethyl cellulose, available as Celquat H-100, L-200, National Starch and Chemical Company), (14) hydroxyalkyl trialkyl ammonium halide hydroxyalkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom (such as hydroxypropyl trimethyl ammonium chloride hydroxyethyl cellulose, available from Union Carbide Company as Polymer JR), (15) dialkyl amino alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, (such as diethyl amino ethyl cellulose, available from Poly Sciences Inc. as DEAE cellulose #05178), (16) carboxyalkyl dextrans, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, and the like, (such as carboxymethyl dextrans, available from Poly Sciences Inc. as #16058), (17) dialkyl aminoalkyl dextran, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as diethyl aminoethyl dextran, available from Poly Sciences Inc. as #5178), (18) amino dextran (available from Molecular Probes Inc), (19) carboxy alkyl cellulose salts, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like (such as sodium carboxymethyl cellulose CMC 7HOF, available from Hercules Chemical Company), (20) gum arabic (such as #G9752, available from Sigma Chemical Company), (21) carrageenan (such as #C1013 available from Sigma Chemical Company), (22) Karaya gum (such as #G0503, available from Sigma Chemical Company), (23) xanthan (such as Keltrol-T, available from Kelco division of Merck and Company), (24) chitosan (such as #C3646, available from Sigma Chemical Company), (25) carboxyalkyl hydroxyalkyl guar, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as carboxymethyl hydroxypropyl guar, available from Auqualon Company), (26) cationic guar (such as Celanese Jaguars C-14-S, C-15, C-17, available from Celanese Chemical Company), (27) n-carboxyalkyl chitin, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as n-carboxymethyl chitin, (28) dialkyl ammonium hydrolyzed collagen protein, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as dimethyl ammonium hydrolyzed collagen protein, available from Croda as Croquats), (29) agar-agar (such as that available from Pfaltz and Bauer Inc), (30) cellulose sulfate salts, wherein the cation is any conventional cation, such as sodium, lithium, potassium, calcium, magnesium, or the like (such as sodium cellulose sulfate #023 available from Scientific Polymer Products), and (31) carboxyalkylhydroxyalkyl cellulose salts, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like (such as sodium carboxymethylhydroxyethyl cellulose CMHEC 43H and 37L available from Hercules Chemical Company); (b) vinyl polymers, such as (1) poly(vinyl alcohol) (such as Elvanol available from Dupont Chemical Company), (2) poly (vinyl phosphate) (such as #4391 available from Poly Sciences Inc.), (3) poly (vinyl pyrrolidone) (such as that available from GAF Corporation), (4) vinyl pyrrolidone-vinyl acetate copolymers (such as #02587, available from Poly Sciences Inc.), (5) vinyl pyrrolidone-styrene copolymers (such as #371, available from Scientific Polymer Products), (6) poly (vinylamine) (such as #1562, available from Poly Sciences Inc.), (7) poly (vinyl alcohol) alkoxylated, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as poly (vinyl alcohol) ethoxylated #6573, available from Poly Sciences Inc.), and (8) poly (vinyl pyrrolidone-dialkylaminoalkyl alkylacrylate), wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as poly (vinyl pyrrolidone-diethylaminomethylmethacrylate) #16294 and #16295, available from Poly Sciences Inc.); (c) formaldehyde resins, such as (1) melamine-formaldehyde resin (such as BC 309, available from British Industrial Plastics Limited), (2) urea-formaldehyde resin (such as BC777, available from British Industrial Plastics Limited), and (3) alkylated urea-formaldehyde resins, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as methylated urea-formaldehyde resins, available from American Cyanamid Company as Beetle 65); (d) ionic polymers, such as (1) poly (2-acrylamide-2-methyl propane sulfonic acid) (such as #175 available from Scientific Polymer Products), (2) poly (N,N-dimethyl-3,5-dimethylene piperidinium chloride) (such as #401, available from Scientific Polymer Products), and (3) poly (methylene-guanidine) hydrochloride (such as #654, available from Scientific Polymer Products); (e) maleic anhydride and maleic acid containing polymers, such as (1) styrene-maleic anhydride copolymers (such as that available as Scripset from Monsanto, and the SMA series available from Arco), (2) vinyl alkyl ether-maleic anhydride copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinyl methyl ether-maleic anhydride copolymer #173, available from Scientific Polymer Products), (3) alkylene-maleic anhydride copolymers, wherein alkylene has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as ethylene-maleic anhydride copolymer #2308, available from Poly Sciences Inc., also available as EMA from Monsanto Chemical Company), (4) butadiene-maleic acid copolymers (such as #07787, available from Poly Sciences Inc.), (5) vinylalkylether-maleic acid copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinylmethylether-maleic acid copolymer, available from GAF Corporationas Gantrez S-95), and (6) alkyl vinyl ether-maleic acid esters, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as methyl vinyl ether-maleic acid ester #773, available from Scientific Polymer Products); (f) acrylamide containing polymers, such as (1) poly (acrylamide) (such as #02806, available from Poly Sciences Inc.), (2) acrylamide-acrylic acid copolymers (such as #04652, #02220, and #18545, available from Poly Sciences Inc.), and (3) poly (N,N-dimethyl acrylamide) (such as #004590, available from Poly Sciences Inc.); and (g) poly (alkylene imine) containing polymers, wherein alkylene has two (ethylene), three (propylene), or four (butylene) carbon atoms, such as (1) poly(ethylene imine) (such as #135, available from Scientific Polymer Products), (2) poly (ethylene imine) epichlorohydrin (such as #634, available from Scientific Polymer Products), and (3) alkoxylated poly (ethylene imine), wherein alkyl has one (methoxylated), two (ethoxylated), three (propoxylated), or four (butoxylated) carbon atoms (such as ethoxylated poly (ethylene imine #636, available from Scientific Polymer Products); and the like, as well as blends or mixtures of any of the above, with starches and latexes being particularly preferred because of their availability and applicability to paper. Any mixtures of the above ingredients in any relative amounts can be employed.

The second ink-receiving coating layer typically has a thickness of from about 1 to about 25 microns, preferably from about 3 to about 8 microns, although the thickness can be outside these ranges.

In addition, one or more of the coatings of the recording sheets of the present invention can contain optional antistatic agents. Antistatic components can be present in any effective amount, and if present, typically are present in amounts of from about 0.5 to about 5.0 percent by weight of the coating composition. Examples of antistatic components include both anionic and cationic materials. Examples of anionic antistatic components include monoester sulfosuccinates, such as those of the general formula

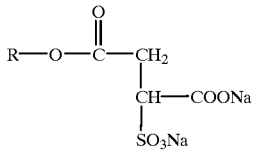

wherein R represents an alkanolamide or ethoxylated alcohol, diester sulfosuccinates, such as those of the general formula

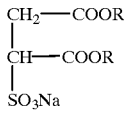

wherein R represents an alkyl group, and sulfosuccinamates, such as those of the general formula

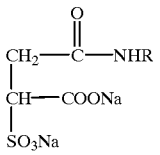

wherein R represents an alkyl group, all commercially available from Alkaril Chemicals as, for example, Alkasurf SS-L7DE, Alkasurf SS-L-HE, Alkasurf SS-OA-HE, Alkasurf SS-L9ME, Alkasurf SS-DA4-HE, Alkasurf SS-1B-45, Alkasurf SS-MA-80, Alkasurf SS-NO, Alkasurf SS-0-40, alkasurf SS-0-60PG, Alkasurf SS-0-70PG, Alkasurf SS-0-75, Alkasurf SS-TA, and the like. Examples of cationic antistatic components include diamino alkanes, such as those available from Aldrich Chemicals, quaternary salts, such as Cordex AT-172 and other materials available from Finetex Corp., and the like. Other suitable antistatic agents include quaternary acrylic copolymer latexes, particularly those of the formula

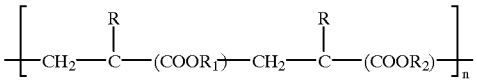

wherein n is a number of from about 10 to about 100, and preferably about 50, R is hydrogen or methyl, $R_1$ is hydrogen, an alkyl group, or an aryl group, and $R_2$ is $N^+(CH_3)_3X^-$, wherein X is an anion, such as Cl, Br, I, $HSO_3$, $SO_3$, $CH_2SO_3$, $H_2PO_4$, $HPO_4$, $PO_4$, or the like, and the degree of quaternization is from about 1 to about 100 percent, including polymers such as polymethyl acrylate trimethyl ammonium chloride latex, such as HX42-1, available from Interpolymer Corp., or the like.

Also suitable as antistatic agents are quaternary choline halides. Examples of suitable quaternary choline halides include (1) choline chloride [(2-hydroxyethyl) trimethyl ammonium chloride] $HOCH_2CH_2N(CH_3)_3Cl$ (Aldrich 23,994-1) and choline iodide $HOCH_2CH_2N(CH_3)_3I$ (Aldrich C7,971-9); (2) acetyl choline chloride $CH_3COOCH_2CH_2N(CH_3)_3Cl$ (Aldrich 13,535-6), acetyl choline bromide $CH_3COOCH_2CH_2N(CH_3)_3Br$ (Aldrich 85,968-0), and acetyl choline iodide $CH_3COOCH_2CH_2N(CH_3)_3I$ (Aldrich 10,043-9); (3) acetyl-β-methyl choline chloride $CH_3COOCH(CH_3)CH_2N(CH_3)Cl$ (Aldrich A1,800-1) and acetyl-β-methyl choline bromide $CH_3COOCH(CH_3)CH_2N(CH_3)_3Br$ (Aldrich 85,554-5); (4) benzoyl choline chloride $C_6H_5COOCH_2CH_2N(CH_3)_3Cl$ (Aldrich 21,697-6); (5) carbamyl choline chloride $H_2NCOOCH_2CH_2N(CH_3)_3Cl$ (Aldrich C240-9); (6) D,L-carnitinamide hydrochloride $H_2NCOCH_2CH(OH)CH_2N(CH_3)_3Cl$ (Aldrich 24,783-9); (7) D,L-carnitine hydrochloride $HOOCCH_2CH(OH)CH_2N(CH_3)_3Cl$ (Aldrich C1,600-8); (8) (2-bromo ethyl) trimethyl ammonium chloride [bromo choline chloride] $BrCH_2CH_2N(CH_3)_3Br$ (Aldrich 11,719-6); (9) (2-chloro ethyl) trimethyl ammonium chloride [chloro choline chloride) $ClCH_2CH_2N(CH_3)_3Cl$ (Aldrich 23,443-5); (10) (3-carboxy propyl) trimethyl ammonium chloride $HOOC(CH_2)_3N(CH_3)_3Cl$ (Aldrich 26,365-6); (11) butyryl choline chloride $CH_3CH_2CH_2COOCH_2CH_2N(CH_3)_3Cl$ (Aldrich 85,537-5); (12) butyryl thiocholine iodide $CH_3CH_2CH_2COSCH_2CH_2N(CH_3)_3I$(Aldrich B10,425-6); (13) S-propionyl thiocholine iodide $C_2H_5COSCH_2CH_2N(CH_3)I$(Aldrich 10,412-4); (14) S-acetylthiocholine bromide $CH_3COSCH_2CH_2N(CH_3)_3Br$ (Aldrich 85,533-2) and S-acetylthiocholine iodide $CH_3COSCH_2CH_2N(CH_3)_3I$ (Aldrich A2,230-0); (15) suberyl dicholine dichloride $[-(CH_2)_3COOCH_2CH_2N(CH_3)_3Cl]_2$ (Aldrich 86,204-5) and suberyl dicholine diiodide $[-(CH_2)_3COOCH_2CH_2N(CH_3)_3I]_2$ (Aldrich 86,211-8); and the like, as well as mixtures thereof.

Additional examples of materials suitable as antistatic components include those disclosed in copending application Ser. Nos. 08/034,917, 08/034,943, 08/033,917, 08/034,445, and 08/033,918, the disclosures of each of which are totally incorporated herein by reference.

The antistatic agent can be present in any effective amount; typically, the antistatic agent is present in an amount of from about 1 to about 5 percent by weight of the coating, and preferably in an amount of from about 1 to about 2 percent by weight of the coating, although the amount can be outside these ranges.

Further, one or more of the coatings of the recording sheets of the present invention can contain one or more optional biocides. Examples of suitable biocides include (A) non-ionic biocides, such as (1) 2-hydroxypropylmethane thiosulfonate (Busan 1005, available from Buckman Laboratories Inc.); (2) 2-(thio cyanomethyl thio) benzothiazole (Busan 30WB, 72WB, available from Buckman Laboratories Inc.); (3) methylene bis (thiocyanate) (Metasol T-10, available from Calgon Corporation; AMA-110, available from Vinings Chemical Company; Vichem MBT, available from Vineland Chemical Company; Aldrich 10,509-0); (4) 2-bromo-4'-hydroxyacetophenone (Busan 90, available from Buckman Laboratories); (5) 1,2-dibromo-2,4-dicyanobutane (Metasol CB-210, CB-235, available from Calgon Corporation); (6) 2,2-dibromo-3-nitropropionamide (Metasol RB-20, available from Calgon Corporation; Amerstat 300, available from Drew Industrial Div.); (7) N-α-(1-nitroethyl benzylethylene diamine) (Metasol J-26, available from Calgon Corporation); (8) dichlorophene (G-4, available from Givaudan Corporation); (9) 3,5-dimethyl tetrahydro-2H-1,3,5-thiadiazine-2-thione (SLIME-TROL RX-28, available from Betz Paper Chem Inc.; Metasol D3T-A, available from Calgon Corporation; SLIME ARREST, available from Western Chemical Company); (10) a non-ionic blend of a sulfone, such as bis (trichloromethyl) sulfone and methylene bisthiocyanate (available as SLIME-TROL RX-38A from Betz Paper Chem Inc.); (11) a non-ionic blend of methylene bisthiocyanate and bromonitrostyrene (available as SLIME-TROL RX-41 from Betz Paper Chem Inc.); (12) a non-ionic blend of 2-(thiocyanomethylthio) benzothiazole (53.2% by weight) and 2-hydroxypropyl methanethiosulfonate (46.8% by weight) (available as BUSAN 25 from Buckman Laboratories Inc.); (13) a non-ionic blend of methylene bis (thiocyanate) 50 percent by weight and 2-(thiocyanomethylthio) benzothiazole 50 percent by weight (available as BUSAN 1009, 1009WB from Buckman Laboratories Inc.); (14) a non-ionic blend of 2-bromo-4'-hydroxyacetophenone (70 percent by weight) and 2-(thiocyanomethylthio) benzothiazole (30 percent by weight) (BUSAN 93, available from Buckman Laboratories Inc.); (15) a non-ionic blend of 5-chloro-2-methyl-4-isothiazoline-3-one (75 percent by weight) and 2-methyl-4-isothiazolin-3-one (25 percent by weight), (available as AMERSTAT 250 from Drew Industrial Division; NALCON 7647, from NALCO Chemical Company; Kathon LY, from Rohm and Haas Co.); and the like, as well as mixtures thereof; (B) anionic biocides, such as (1) anionic potassium N-hydroxymethyl-N-methyl-dithiocarbamate (available as BUSAN 40 from Buckman Larboratories Inc.); (2) an anionic blend of N-hydroxymethyl-N-methyl dithiocarbamate (80% by weight) and sodium 2-mercapto benzothiazole (20% by weight) (available as BUSAN 52 from Buckman Laboratories Inc.); (3) an anionic blend of sodium dimethyl dithiocarbamate 50 percent by weight and (disodium ethylenebis-dithiocarbamate) 50% by weight (available as METASOL 300 from Calgon Corporation; AMERSTAT 272 from Drew Industrial Division; SLIME CONTROL F from Western Chemical Company); (4) an anionic blend of N-methyldithiocarbamate 60 percent by weight and disodium cyanodithioimidocarbonate 40 percent by weight (available as BUSAN 881 from Buckman Laboratories Inc); (5) An anionic blend of methylene bis-thiocyanate (33% by weight), sodium dimethyl-dithiocarbamate (33% by weight), and sodium ethylene bisdithiocarbamate (33% by weight) (available as AMERSTAT 282 from Drew Industrial Division; AMA-131 from Vinings Chemical Company); (6) sodium dichlorophene (G-4-40, available from Givaudan Corp.); and the like, as well as mixtures thereof; (C) cationic biocides, such as (1) cationic poly (oxyethylene (dimethylamino)-ethylene (dimethylamino) ethylene dichloride) (Busan 77, available from Buckman Laboratories Inc.); (2) a cationic blend of methylene bisthiocyanate and dodecyl guanidine hydrochloride (available as SLIME TROL RX-31, RX-32, RX-32P, RX-33, from Betz Paper Chem Inc.); (3) a cationic blend of a sulfone, such as bis(trichloromethyl) sulfone and a quaternary ammonium chloride (available as SLIME TROL RX-36 DPB-865 from Betz Paper Chem. Inc.); (4) a cationic blend of methylene bis thiocyanate and chlorinated phenols (available as SLIME-TROL RX-40 from Betz Paper Chem Inc.); and the like, as well as mixtures thereof. The biocide can be present in any effective amount; typically, the biocide is present in an amount of from about 10 parts per million to about 3 percent by weight of the coating, although the amount can be outside this range.

Additionally, one or more of the coatings of the recording sheets of the present invention can contain optional filler components. Fillers can be present in any effective amount, and if present, typically are present in amounts of from about 1 to about 60 percent by weight of the coating composition. Examples of filler components include colloidal silicas, such as Syloid 74, available from Grace Company (preferably present, in one embodiment, in an amount of about 20 weight percent), titanium dioxide (available as Rutile or Anatase from NL Chem Canada, Inc.), hydrated alumina (Hydrad TMC-HBF, Hydrad TM-HBC, available from J.M. Huber Corporation), barium sulfate (K.C. Blanc Fix HD80, available from Kali Chemie Corporation), calcium carbonate (Microwhite Sylacauga Calcium Products), high brightness clays (such as Engelhard Paper Clays), calcium silicate (available from J.M. Huber Corporation), cellulosic materials insoluble in water or any organic solvents (such as those available from Scientific Polymer Products), blend of calcium fluoride and silica, such as Opalex-C available from Kemira.O.Y, zinc oxide, such as Zoco Fax 183, available from Zo Chem, blends of zinc sulfide with barium sulfate, such as Lithopane, available from Schteben Company, and the like, as well as mixtures thereof. Brightener fillers can enhance color mixing and assist in improving print-through in recording sheets of the present invention.

The coatings containing the microspheres (as well as one or more of the optional ingredients, if present) can be applied to either one or both surfaces of the substrate, and can be applied to the substrate by any suitable technique, such as size press treatment, dip coating, reverse roll coating, extrusion coating, or the like. For example, the coating can be applied with a KRK size press (Kumagai Riki Kogyo Co., Ltd., Nerima, Tokyo, Japan) by dip coating and can be applied by solvent extrusion on a Faustel Coater. The KRK size press is a lab size press that simulates a commercial size press. This size press is normally sheet fed, whereas a commercial size press typically employs a continuous web. On the KRK size press, the substrate sheet is taped by one end to the carrier mechanism plate. The speed of the test and the roll pressures are set, and the coating solution is poured into the solution tank. A 4 liter stainless steel beaker is situated underneath for retaining the solution overflow. The coating solution is cycled once through the system (without moving the substrate sheet) to wet the surface of the rolls and then returned to the feed tank, where it is cycled a second time. While the rolls are being "wetted", the sheet is fed through the sizing rolls by pressing the carrier mechanism start button. The coated sheet is then removed from the carrier mechanism plate and is placed on a 12 inch by 40 inch sheet of 750 micron thick Teflon for support and is dried on the Dynamic Former drying drum and held under restraint to prevent shrinkage. The drying temperature is approximately 105° C. This method of coating treats both sides of the substrate simultaneously.

In dip coating, a web of the material to be coated is transported below the surface of the liquid coating composition by a single roll in such a manner that the exposed site is saturated, followed by removal of any excess coating by the squeeze rolls and drying at 100° C. in an air dryer. The liquid coating composition generally comprises the desired coating composition dissolved in a solvent such as water, methanol, or the like. The method of surface treating the substrate using a coater results in a continuous sheet of substrate with the coating material applied first to one side and then to the second side of this substrate. The substrate can also be coated by a slot extrusion process, wherein a flat die is situated with the die lips in close proximity to the web of substrate to be coated, resulting in a continuous film of the coating solution evenly distributed across one surface of the sheet, followed by drying in an air dryer at 100° C.

Ink jet printing processes are well known, and are described in, for example, U.S. Pat. No. 4,601,777, U.S. Pat. No. 4,251,824, U.S. Pat. No. 4,410,899, U.S. Pat. No. 4,412,224, and U.S. Pat. No. 4,532,530, the disclosures of each of which are totally incorporated herein by reference. In a particularly preferred embodiment, the printing apparatus employs a thermal ink jet process wherein the ink in the nozzles is selectively heated in an imagewise pattern, thereby causing droplets of the ink to be ejected in imagewise pattern. In another preferred embodiment, the substrate is printed with an aqueous ink and thereafter the printed substrate is exposed to microwave radiation, thereby drying the ink on the sheet. Printing processes of this nature are disclosed in, for example, U.S. Pat. No. 5,220,346, the disclosure of which is totally incorporated herein by reference.

Specific embodiments of the invention will now be described in detail. These examples are intended to be illustrative, and the invention is not limited to the materials, conditions, or process parameters set forth in these embodiments. All parts and percentages are by weight unless otherwise indicated.

The optical density measurements recited herein were obtained on a Pacific Spectrograph Color System. The system consists of two major components, an optical sensor and a data terminal. The optical sensor employs a 6 inch integrating sphere to provide diffuse illumination and 8 degrees viewing. This sensor can be used to measure both transmission and reflectance samples. When reflectance samples are measured, a specular component may be included. A high resolution, full dispersion, grating monochromator was used to scan the spectrum from 380 to 720 nanometers. The data terminal features a 12 inch CRT display, numerical keyboard for selection of operating parameters and the entry of tristimulus values, and an alphanumeric keyboard for entry of product standard information.

EXAMPLE I

Transparency sheets were prepared as follows. Solutions containing the first layer coating compositions (contents detailed below as A through F) and the second layer coating compositions (contents detailed below as V through Z) were prepared by admixing the contents in omni homogenizers for two hours, followed by allowing the resulting solutions to sit overnight for the removal of air bubbles. The coatings were of the following compositions:

First Layer Coating Compositions:

A: hydroxypropyl methyl cellulose phthalate (Shin-etsu Chemical), 97 percent by weight; Spheriglass microspheres (EP250 P2, Potters Industries), 3 percent by weight. Solids present in acetone solution in a concentration of 5 percent by weight.

B: hydroxypropyl methyl cellulose succinate (Shin-etsu Chemical), 97 percent by weight; Spheriglass microspheres (EP250 P2, Potters Industries), 3 percent by weight. Solids present in acetone solution in a concentration of 5 percent by weight.

C: vinyl alcohol-vinyl acetate copolymer with vinyl alcohol monomer content of 9 percent by weight (#379 Scientific Polymer Products), 97 percent by weight; Spheriglass microspheres (1000.2A, Potters Industries), 3 percent by weight. Solids present in methanol solution in a concentration of 5 percent by weight.

D: cellulose triacetate (#031 Scientific Polymer Products), 97 percent by weight; Spheriglass microspheres (EP250 P2, Potters Industries), 3 percent by weight. Solids present in acetone solution in a concentration of 5 percent by weight.

E: poly (2-hydroxyethyl methacrylate) (#815, Scientific Polymer Products), 97 percent by weight; glass beads (#07666 Polysciences), 3 percent by weight. Solids present in methanol solution in a concentration of 5 percent by weight.

F: poly (2-hydroxyethyl methacrylate) (#815, Scientific Polymer Products), 100 percent by weight in methanol solution in a solids concentration of 5 percent by weight. [no microspheres]

Second Layer Coating Compositions:

V: hydroxypropyl methyl cellulose (K35LV, Dow Chemicals), 99.75 percent by weight; Spheriglass microspheres (EP250 P2, Potters Industries), 0.25 percent by weight. Solids present in water solution in a concentration of 6 percent by weight.

W: hydroxypropyl methyl cellulose (K35LV, Dow Chemicals), 99.75 percent by weight; Spheriglass microspheres (1000.2A, Potters Industries), 0.25 percent by weight. Solids present in water solution in a concentration of 6 percent by weight.

X: hydroxypropyl methyl cellulose (K35LV, Dow Chemicals), 75 percent by weight; polyester latex (Eastman Kodak AQ29D), 24.75 percent by weight; glass beads (#07666, Poly Sciences), 0.25 percent by weight. Solids present in water solution in a concentration of 6 percent by weight.

Y: hydroxypropyl methyl cellulose (K35LV, Dow Chemicals), 80 percent by weight; acrylic emulsion (Rhoplex B-15J Rohm and Haas), 19.75 percent by weight; glass beads (#07666, Polysciences), 0.25 percent by weight.

Z: hydroxypropyl methyl cellulose (K35LV, Dow Chemicals), 100 percent by weight in water solution in a solids concentration of 6 percent by weight. [no microspheres]

Transparency sheets were then prepared by providing Mylar® polyester cut sheets (8.5×11 inches) in a thickness of 100 microns and coating these sheets on both sides via a dip coating process with the first layer coating composition (indicated for each transparency in the Table below by letter). Subsequent to air drying at 100° C. for a period of 10 minutes and monitoring the weight prior to and subsequent to coating, the dried base sheets were coated on each side with about 800 milligrams of the first coating material (1600 milligrams total coating weight for the two-sided transparency) in a thickness of about 8 microns on each side. These coated sheets were then further overcoated with the second layer coating composition (indicated for each transparency in the Table below by letter) by a dip coating process. Subsequent to air drying at 100° C. for a period of 10 minutes and monitoring the weight prior to and subsequent to coating, the dried base sheets were coated on each side with about 700 milligrams of the second, hydrophilic coating material (1400 milligrams total coating weight for the two-sided transparency) in a thickness of about 7 microns on each side.

The transparency sheets thus prepared were incorporated into a Hewlett-Packard 500-C color ink jet printer containing inks of the following compositions:

Cyan: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 30 percent by weight Projet Cyan 1 dye, obtained from ICl, 45.45 percent by weight water.

Magenta: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 2.5 percent by weight Triton Direct Red 227, obtained from Tricon, 72.95 percent by weight water.

Yellow: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 3 percent by weight Hoechst Duasyn Brilliant Yellow SF-GL VP220, obtained from Hoechst, 72.45 percent by weight water.

Images were generated by printing block patterns for magenta, cyan, yellow, and black. The images thus formed were dried by exposure to microwave radiation with a Citizen Model No. JM55581, obtained from Consumers, Mississauga, Ontario, Canada, set at 700 Watts output power at 2450 MHz frequency. The black images were "process black" (i.e., formed by superimposition of cyan, magenta, and yellow images). The drying times and optical densities for the resulting images were as follows:

| Coating Composition | | Drying Time (seconds) | | | | Optical Density | | | |
|---|---|---|---|---|---|---|---|---|---|
| First Layer | Second Layer | black | cyan | magenta | yellow | black | cyan | magenta | yellow |
| A | V | 10 | 20 | 20 | 10 | 1.85 | 1.75 | 1.55 | 1.05 |
| B | V | 10 | 15 | 15 | 15 | 1.95 | 1.70 | 1.50 | 0.95 |
| C | W | 15 | 15 | 15 | 15 | 1.85 | 1.68 | 1.50 | 0.95 |
| D | X | 15 | 20 | 20 | 15 | 1.87 | 1.74 | 1.39 | 0.97 |
| E | Y | 10 | 15 | 20 | 15 | 1.70 | 1.58 | 1.35 | 0.90 |
| F | Z | 30 | 20 | 30 | 20 | 2.50 | 2.07 | 1.45 | 0.95 |

As the results indicate, the recording sheets coated with the coating compositions containing microspheres exhibited improved drying times compared to the recording sheet coated with the coating compositions containing no microspheres.

EXAMPLE II

Transparency sheets were prepared by the process described in Example I. The coatings were of the same compositions indicated in Example I.

The transparency sheets thus prepared were incorporated into a Hewlett-Packard 500-C color ink jet printer containing inks of the compositions indicated in Example I. Images were generated by printing block patterns for magenta, cyan, yellow, and black. The images thus formed were allowed to dry at 25° C. The black images were "process black" (i.e., formed by superimposition of cyan, magenta, and yellow images). The drying times and optical densities for the resulting images were as follows:

| Coating Composition | | Drying Time (minutes) | | | | Optical Density | | | |
|---|---|---|---|---|---|---|---|---|---|
| First Layer | Second Layer | black | cyan | magenta | yellow | black | cyan | magenta | yellow |
| A | V | 6 | 3 | 2 | 1 | 1.95 | 1.65 | 1.50 | 0.99 |
| B | V | 6 | 2 | 3 | 1 | 1.85 | 1.60 | 1.40 | 1.05 |
| C | W | 5 | 2 | 2 | 1 | 1.85 | 1.68 | 1.50 | 0.90 |
| D | X | 6 | 3 | 3 | 1 | 2.20 | 2.00 | 1.50 | 0.95 |
| E | Y | 6 | 3 | 2 | 1 | 2.10 | 1.90 | 1.55 | 0.95 |
| F | Z | 10 | 5 | 5 | 2 | 2.95 | 2.10 | 1.37 | 0.95 |

As the results indicate, the recording sheets coated with the coating compositions containing microspheres exhibited improved drying times compared to the recording sheet coated with the coating compositions containing no microspheres.

Other embodiments and modifications of the present invention may occur to those skilled in the art subsequent to a review of the information presented herein; these embodiments and modifications, as well as equivalents thereof, are also included within the scope of this invention.

What is claimed is:

1. A printing process which comprises the steps of (a) incorporating into an ink jet printing apparatus containing an aqueous ink a recording sheet which consists essentially of (1) a substrate; (2) a first coating layer which comprises a binder and microspheres having an average particle diameter of at least about 1 micron; (3) a second, ink-receiving coating layer situated so that the first coating layer is between the second, ink-receiving coating layer and the substrate, said second, ink-receiving layer comprising a hydrophilic binder and microspheres having an average particle diameter of at least about 1 micron; (4) an optional antistatic agent; (5) an optional biocide; and (6) an optional filler; (b) causing droplets of the ink to be ejected in an imagewise pattern onto a surface of the recording sheet containing microspheres, thereby generating images on the recording sheet; and (c) thereafter exposing the substrate to microwave radiation, thereby drying the recording liquid on the recording sheet.

2. A printing process according to claim 1 wherein the microspheres in the first coating layer and the microspheres in the second coating layer are hollow.

3. A printing process according to claim 1 wherein the microspheres in the first coating layer and the microspheres in the second coating layer are solid.

4. A printing process according to claim 1 wherein the microspheres in the first coating layer and the microspheres in the second coating layer have an average particle diameter of from about 1 to about 50 microns.

5. A printing process according to claim 1 wherein the microspheres in the first coating layer and the microspheres in the second coating layer have an average particle diameter of from about 1 to about 10 microns.

6. A printing process according to claim 1 wherein the microspheres in the first coating layer and the microspheres in the second coating layer are of a material selected from the group consisting of sodium borosilicate glass, silica glass, alumino-silicate ceramic, soda lime glass, phenolic polymers, vinylidene chloride-acrylonitrile, plastic, and mixtures thereof.

7. A printing process according to claim 1 wherein the first coating layer has a thickness of from about 1 to about 25 microns.

8. A printing process according to claim 1 wherein the second, ink-receiving coating layer has a thickness of from about 1 to about 25 microns.

9. A printing process according to claim 1 wherein the recording sheet contains an antistatic agent.

10. A printing process according to claim 1 wherein the recording sheet contains a biocide.

* * * * *